United States Patent [19]

Crowley

[11] 4,271,350

[45] Jun. 2, 1981

[54] BLANKET WIRE UTILIZING POSITIVE TEMPERATURE COEFFICIENT RESISTANCE HEATER

[75] Inventor: George C. Crowley, Chicago, Ill.

[73] Assignee: Sunbeam Corporation, Chicago, Ill.

[21] Appl. No.: 150,873

[22] Filed: May 19, 1980

[51] Int. Cl.[3] ..... H05B 3/54

[52] U.S. Cl. ..... 219/549; 29/611; 174/106 SC; 174/107; 174/120 SC; 219/504; 219/528; 219/548; 252/511; 264/174; 338/22 R; 338/214

[58] Field of Search ..... 219/212, 504, 510, 528, 219/544, 548, 549; 174/106 SC, 107, 120 SC; 252/501, 511; 264/105, 22, 174, 235; 338/22 R, 22 SC, 214; 29/611, 619

[56] References Cited

U.S. PATENT DOCUMENTS

| | | | |
|---|---|---|---|
| 2,745,944 | 5/1956 | Price | 174/107 X |
| 2,820,085 | 1/1958 | Crowley | 174/107 |
| 3,049,584 | 8/1962 | D'Ascoli | 174/120 SC |
| 3,410,984 | 11/1968 | Sandford et al. | 219/212 |
| 3,793,716 | 2/1974 | Smith-Johannsen | 29/611 |
| 3,814,899 | 6/1974 | Gordon et al. | 219/212 |
| 3,858,144 | 12/1974 | Bedard et al. | 338/22 R |
| 3,914,363 | 10/1975 | Bedard et al. | 264/105 |
| 4,008,367 | 2/1977 | Sünderhauf | 174/107 |
| 4,055,526 | 10/1977 | Kiyokawa et al. | 219/528 X |

FOREIGN PATENT DOCUMENTS

| | | | |
|---|---|---|---|
| 2024579 | 1/1980 | United Kingdom | 219/528 |

*Primary Examiner*—Volodymyr Y. Mayewsky
*Attorney, Agent, or Firm*—George R. Clark; Neil M. Rose

[57] ABSTRACT

A heating element for use in an electric blanket or the like including conductors spaced apart in a positive temperature coefficient (PTC) material which serves as a self-limiting heater. The conductors are separated by a spacer which prevents the conductors from engaging each other when the PTC material softens or melts during annealing thereof. A coating of material having a higher melting point than the PTC material is placed over the PTC material to maintain its shape during the annealing process.

6 Claims, 4 Drawing Figures

BLANKET WIRE UTILIZING POSITIVE TEMPERATURE COEFFICIENT RESISTANCE HEATER

BACKGROUND OF THE INVENTION

The basic concept of utilizing a positive temperature coefficient resistance heater is disclosed in Sandford et al U.S. Pat. No. 3,410,984. The Sandford et al patent discloses an electric blanket in which the blanket wire for distributing heat over the blanket surface includes a pair of low resistance conductors which are spaced apart by the positive temperature coefficient material which serves as the heater for the blanket. The PTC material in the Sandford et al patent is described as a polyethylene which has dispersed in it electrically conductive particles such as carbon black to provide the desired characteristics in which the resistance of the material increases with increasing temperature.

Electric blankets have typically been constructed including some sort of flexible fabric shell which is formed with pockets or passageways disposed in parallel, spaced relation and extending lengthwise of the blanket shell. These passageways receive an elongated heating wire which serves to deliver heat to the entire area of the blanket when the blanket is connected to a suitable source of power. One of the basic problems which has faced blanket designers is that of providing means of sensing overheat conditions in order that the risk of fire and injury may be minimized. The basis of the problem is the fact that a blanket which will heat evenly when laid flat and either uncovered or covered uniformly will tend to have dangerous overheat conditions if the blanket is bunched or folded so that heat delivered to local areas is not dissipated at the same rate as the same heat in other areas. The continuing of these overheat conditions often results in attaining a temperature at which the insulation on the electric heater breaks down or combustion of the blanket material occurs.

In order to overcome or prevent such local overheat conditions, electric blankets have been provided with various types of temperature sensing means to deactivate or disable portions of the blanket involved in the overheat conditions. One approach has been to provide a number of series connected discrete bimetallic thermostats throughout the length of the blanket heater wire. These thermostats are closely spaced enough to sense most overheating that may develop. Another type of prior art heater involves a sensing wire fabricated with the heating wire or positioned closely adjacent thereto to provide a continuous sensing of the temperature conditions along the heating element wire. Such a sensing element or wire utilizes a positive or negative temperature coefficient of resistance material between two spaced conductors. By monitoring the overall resistance of the wire, it is possible to sense an overheat condition and deactivate the blanket. The approach followed in the Sandford et al patent referred to above represents an improvement over the sensor wire approach in that the heating element wire itself is self-limiting so that any local overheat condition causes an increase in the resistance of the heating element material in that area thereby reducing the portion of the power delivered to that part of the blanket and lessening the tendency of the overheat condition to continue.

Although the Sandford et al patent issued more than ten years ago, there have been no electric blankets marketed utilizing the type of PTC heating element wire disclosed therein. The reasons relate to the problems in fabricating a wire which will have the proper resistance characteristics as the temperature of the wire is varied. There are also problems in producing positive temperature coefficient resistance materials which will have uniform resistance characteristics over the expected life of the product. Certain aging conditions have a tendency to cause wide fluctuation in the resistance characteristics. In an effort to resolve some of these resistance and aging problems, various alternative approaches have been taken to the PTC material. The composition of the material as well as the manner of processing, including annealing, has evolved considerably. The patents to Bedard et al U.S. Pat. No. 3,858,144 and Bedard et al U.S. Pat. No. 3,914,363 are noted in connection with the disclosure of various approaches to the fabrication of the PTC wire. The above noted Bedard et al patents recognize a need for annealing the PTC wire at a temperature at or above the melting point of the PTC material. This condition necessitates the use of some sort of thermoplastic coating material around the PTC material to maintain the integrity of the PTC wire during the annealing process.

Another problem which is encountered is that of preventing short-circuiting of the conductors during the annealing process since the PTC material which holds the conductors in spaced relation tends to soften considerably and the conductors themselves are often mechanical stresses which tend to cause the conductors to shift their relative spacing within the PTC material. In this connection, the patent to Smith-Johannsen U.S. Pat. No. 3,793,716 is noted. The Smith-Johannsen patent shows the use of a braided envelope which is placed around the conductors to prevent contact between the conductors and to control their separation. Another patent of interest with respect to the use of separators is Crowley U.S. Pat. No. 2,820,085.

Another problem involved in the proper design of a PTC blanket wire is that of achieving satisfactory flexibility in the wire. Most of the prior art work with respect to self-limiting PTC heater wires has been done in connection with wire for use in industrial equipment wire. The wire is wrapped around pipes or similar pieces of equipment. However, in an electric blanket, it is necessary that the wire be very small in cross-section and flexible so as to permit the blanket shell in which the heating element is located to be flexed and folded easily.

SUMMARY OF THE INVENTION

In order to overcome the problems associated with the prior art PTC wires, we have developed a wire having the desired flexibility and means for maintaining the physical integrity of the wire through the annealing process. This wire involves the use of stranded insulating cores on which the conductor wires are wound and flexible spacers which are positioned between the conductors to insure the spacing of the conductors and the use of multiple layers on top of the PTC material. These layers include a first thermoplastic rubber layer which maintains the integrity of the PTC during annealing and a polyvinyl chloride insulation over the thermoplastic rubber, the PVC insulation being designed to provide a seal and permit proper electrical insulation for the blanket wire.

It is therefore an object of the present invention to provide an improved electric blanket heating wire having improved flexibility and uniform resistance characteristics.

It is another object of the present invention to provide an improved electric blanket heating wire having the spaced conductors wound on stranded insulated cores with PTC material extruded over such wrapped cores and with a spacer core positioned between the conductors.

It is a further object of the present invention to provide an improved electric blanket heating wire having spaced conductors separated by positive temperature coefficient material which serves as the heating element with such PTC material enclosed in a thermoplastic rubber envelope and a polyvinyl chloride envelope around the thermoplastic rubber to provide electrical insulation.

Other objects and advantages will become apparent as the following description proceeds and the features of novelty which characterize the invention will be pointed out in the claims annexed to and forming a part of the specification.

BRIEF DESCRIPTION OF THE DRAWINGS

For a better understanding of the present invention, reference may be had to the accompanying drawings in which.

DESCRIPTION OF THE PREFERRED EMBODIMENT

Figure 1:
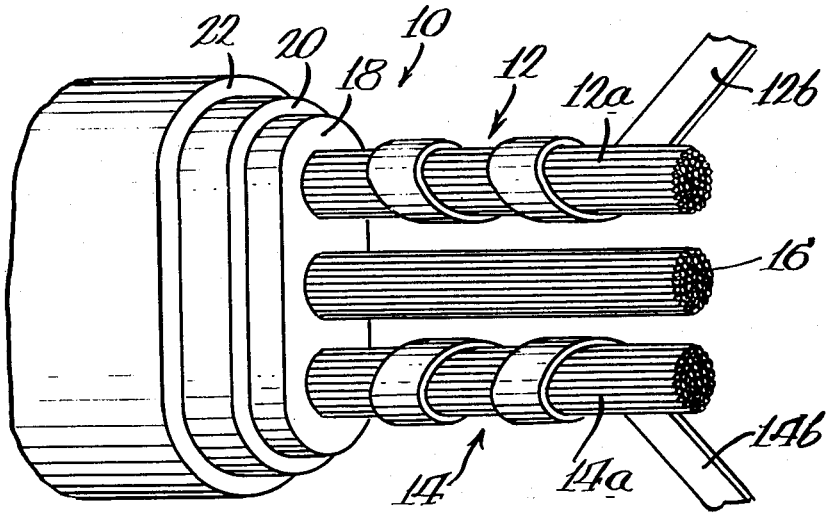
FIG. 1 is a perspective view of a preferred embodiment of our invention.

Referring to FIG. 1 of the drawings, there is shown a preferred embodiment of our PTC heating element which is designated generally by reference numeral 10. It should be understood that the heating element 10 as used in an electric blanket would be on the order of 175' long as disposed in a fabric shell and would have suitable connectors to supply electric power to the element. To facilitate disclosure, only a small sectioned portion of the element is shown in perspective and greatly enlarged. The heating element 10 includes a pair of composite conductors 12 and 14 each of which includes a supporting core **12*a* and 14*a* respectively and a helically wrapped conductor wire 12*b* and 14*b* respectively. Between the two composite conductors 12 and 14, there is positioned a spacer member 16** for a purpose which will be described in greater detail below.

The supporting cores **12*a* and 14*a* and the spacer member 16 are preferably formed of a plurality of glass or rayon strands which combine to form a thread of approximately 0.018 inches in diameter. The composite cores are strong and very flexible, resulting in a heating element which itself is flexible and able to conform to the contour of a fabric blanket shell. The center to center distance between the cores 12 and 14 is on the order of 0.100 inches. The wire 12*b* and 14*b* wrapped on the cores 12*a* and 14*a* is made of any suitable flexible and conductive material but cadmium bronze alloy 162** wire or pure copper is preferable, the cross-sectional dimension of the wire being 0.025 inches by 0.010 inches and having a resistance of 0.3 ohms per foot of lineal conductor when wrapped with a pitch of about twice the width of the conductor or 0.050 inches.

The composite conductors 12 and 14 and the spacer member 16 are supported in uniformly spaced relation by extruded PTC material 18 which extends entirely around the conductors and spacer as shown in FIG. 1. The various types of PTC material usable as the heating or resistance material 18 in the heating element 10 are well known in the art. As a consequence of the element 10 being utilized in an electric blanket, the material 18 must of necessity be reasonably flexible. The most commonly known material includes polyethylene loaded with carbon black to produce the positive temperature coefficient characteristics which are required. There are also known silicon rubbers as well as polyvinyl chloride and carbon which produce the desired PTC characteristics.

In the normal operation of the heating element 10, the conductor wires **12*a* and 14*a* are connected to a source of alternating current resulting in a potential difference existing between the wires 12*b* and 14*b* causing a current flow through the PTC material 18. The PTC material 18 is compounded such that in the configuration described above, when energized at 115 volts AC, there is produced 1.5 watts plus or minus 0.25 watts per foot of the heating element 10 at room temperature or 72° F. As the temperature of any portion of the heating element increases, the resistance of the material 18** increases thereby reducing the wattage per foot produced in that section of the heating element.

This self-limiting characteristic is extremely advantageous in connection with a heating element wire to be used in an electric blanket since the response to overheat conditions will be essentially as required in the localized area of the overheating. In any of the prior art blankets utilizing discrete thermostats at spaced points in an electric blanket, serious overheat conditions could occur which would not immediately be sensed if the nearest thermostat were some distance from the location of the overheat condition. In the case of the PTC heating element 10 described herein, the self-limiting of the heat delivered to a particular overheated area is immediate and localized to the area in which the overheat occurs.

In normal production, the PTC material 18 is extruded over the composite conductors 12 and 14 and the spacer 16. The preferred material, polyethylene, loaded with carbon, must be annealed to obtain the desired temperature resistance characteristics. The required annealing temperatures are at or above the melting point of the polyethylene which softens at 110° C. and is fairly fluid at 150° C. In order to maintain the integrity of the PTC material 18 during the annealing process, there is extruded on top and around the material 18, a coating 20 of thermoplastic rubber insulation, the thickness of the coating 20 being on the order of 0.004 inches to 0.007 inches. The thermoplastic rubber 20 has a melting point which is well above the annealing temperature of the PTC material 18 so that the coating 20 prevents distortion of the material 18 during the annealing process.

Since the PTC material 18 tends to become softened during the annealing process, there is risk that as a consequence of residual stresses or flexing, the conductors 12 and 14 might move into engagement with each other, thereby resulting in a short between the helical resistance wires 12b and 14b. In order to eliminate this possibility, an insulating core 16 is positioned between the composite conductors 12 and 14. The core 16 is of comparable size to the supporting cores 12a and 14a, thereby insuring that the conductors 12 and 14 will be maintained at a reasonable spacing and thereby maintaining a substantial path that current must flow through the PTC material 18 to go from one of the wires 12b to the other wire 14b. In this way, even though there is some movement of the composite conductors 12 and 14 within the PTC material 18 during the annealing process, the wattage characteristics of the heating element 10 will remain relatively constant.

Following the annealing process, the TPR coating may be removed or left in place, depending on manufacturing costs and size of the resulting element configuration. In any event, it is necessary thereafter to provide a further insulating coating on the exterior of the heating element. A polyvinyl chloride coating 22 is applied to the wire with the thickness of the coating being from 0.004 inches to 0.007 inches. This final coating is necessary to electrically insulate and facilitate moisture sealing of the various connections between sections of the heating element 10 and other portions of the electric blanket in which it is to be used. The resulting structure with the flexible stranded insulating cores 12a, 14a and 16, the supporting PTC material 18 which acts as the resistance material for the heating element and the coatings 20 and 22 is very flexible and suitable for use in connection with electric blankets.

Figure 2:
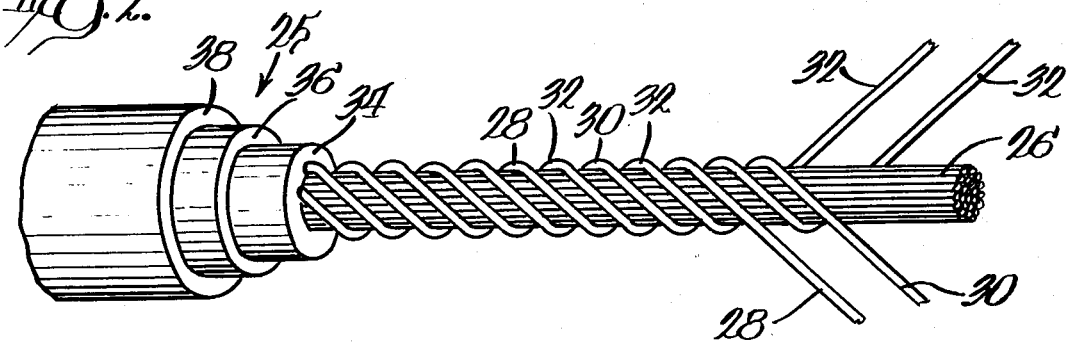
FIG. 2 is a further embodiment of our invention showing the spaced conductors wrapped on a single core.

There are a number of further configurations involving a coaxial arrangement of the resistance wires and the various layers of material which may be equally suitable for use as electric blanket heating elements. Referring to FIG. 2, there is shown an alternative embodiment of a heating element designated generally by reference numeral 25, such element having a flexible insulating center core 26 which is formed of stranded glass or rayon of the same dimensions as the cores 12a, 14a and 16. Wrapped on the insulating core 26 are spaced conductors 28 and 30 which are helically wrapped on the core 26 along with a pair of spacer threads 32 as shown in FIG. 2. The assembly of the core 26, the wires 28 and 30, and the spacer threads 32 are enclosed by an extrusion of PTC material 34 which supports the wires 28 and 30 and threads 32 in spaced relation on the core 26. As in the embodiment of FIG. 1, the current between the conductor wires 28 and 30 must pass through the PTC material 34, thereby producing the heating effect which again is self-limiting insofar as overheat conditions are concerned. The spacer threads 32 are of insulating material and serve to maintain the spaced relation between the conductor wires 28 and 30 during the annealing of the PTC material.

To maintain the integrity of the PTC material 34 during the annealing operation, a thermoplastic rubber coating 36 is extruded around the PTC material 34. As in connection with the embodiment of FIG. 1 and for the same purpose, there is a further polyvinyl chloride coating 38 extruded on the thermoplastic rubber coating 36. The configuration of FIG. 2 provides a flexible and effective PTC heating element for use in connection with electric blankets.

Figure 3:
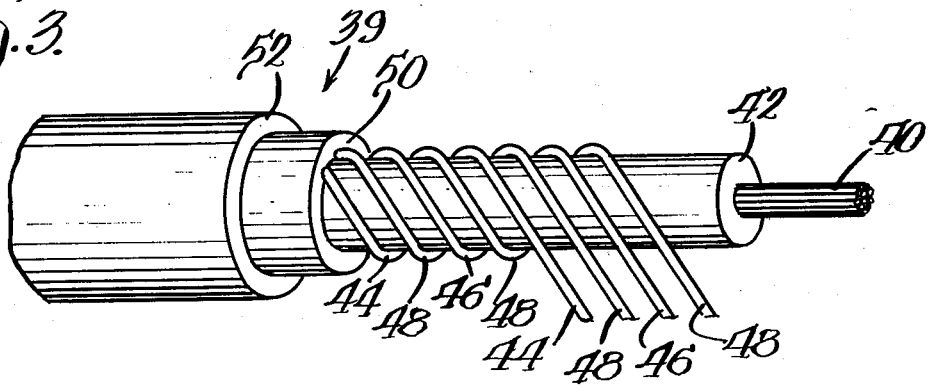
FIG. 3 is a perspective view of another embodiment showing the conductors wrapped on a PTC core rather than having the PTC extruded thereon.

Another alternative embodiment is shown in FIG. 3 and is generally similar to the embodiment of FIG. 2 except for the fact that the PTC material is disposed radially inwardly of the conductor wires rather than being extruded over the conductor wires. In the embodiment of FIG. 3, which is designated generally by reference numeral 39, there is provided a central core 40 which is similar to the cores 12a, 14a, 16 and 26 and is formed of rayon or glass. A coating of PTC material 42 is extruded over the core 40. Helically wound on the exterior surface of the PTC material 42 are spaced conductor wires 44 and 46 with spacer threads 48 disposed helically between the conductor wires as shown. The conducting path for the current flowing between the conductor wires 44 and 46 is inwardly into the PTC material then lengthwise of the heating element 39 to the adjacent conductor wire. The spacer threads 48 are provided to prevent contact between the adjacent conductor wires 44 and 46 when the PTC material 42 softens during the annealing process. As in connection with the earlier embodiments, a thermoplastic rubber coating 50 and a polyvinyl chloride coating 52 are provided for the same purposes as explained in connection with the earlier embodiments.

Figure 4:
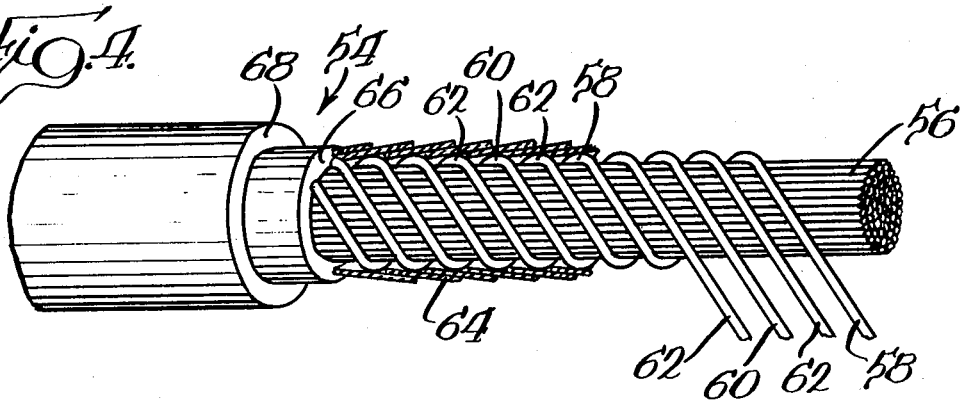
FIG. 4 is a further alternative embodiment using a single stranded core and having the PTC material wrapped rather than extruded on to the conductors.

A fourth embodiment, as shown in FIG. 4, is very similar to the embodiment of FIG. 2; however, the PTC material is wrapped rather than extruded over the conductor wires. Referring to FIG. 4, there is shown the heating element designated generally as 54 having an insulated stranded core 56 on which conductor wires 58 and 60 are helically wound. The spacer threads 62 are provided to prevent shorting of the resistance wires 58 and 60 during the annealing of the PTC material. In the embodiment of FIG. 4, the PTC material is a flat tape 64 which is helically wound over the composite core including the core 56, the conductor wires 58 and 60 and the spacer threads 62. Again, the PTC material is provided with a thermoplastic rubber coating 66 and a polyvinyl chloride coating 68. As is obvious in the last described embodiment, the current path between the conductor wires 58 and 60 is radially outward into the PTC tape material 64 and then lengthwise of the heating element 54 to the adjacent conductors. The resulting heating element is again flexible and suitable for use in electric blankets.

While several embodiments of the present invention have been shown, it will be understood that various changes and modifications will occur to those skilled in the art, and it is contemplated in the appended claims to cover all such changes and modifications as fall within the true spirit and scope of the present invention.

What is claimed as new and desired to be secured by Letters Patent of the United States is:

1. A self-limiting electric heating element adapted for use in flexible heated products such as electric heating pads, electric blankets and the like comprising a pair of spaced elongated conductors each of which include a flexible insulating core supporting a conducting wire helically wound thereon, an envelope of positive temperature coefficient material extruded over said spaced conductors to surround said conductors and providing a conducting path between said resistance wires through said material, a thermoplastic coating enclosing said positive temperature coefficient material, said coating having a melting point above the melting point of said material to maintain the shape during an annealing operation at a temperature above the melting point of said material and below the melting point of said thermoplastic coating, an insulating spacer positioned in said extruded material between said conductors to prevent contact and maintain substantial spacing between said wires during extrusion or annealing, a coating of insulating material surrounding said thermoplastic coating.

2. The heating element of claim 1 wherein said insulating spacer and said insulating core are formed of glass or rayon fibers and wound in cross-section with substantially equal diameters and said coating of insulating material comprises polyvinyl chloride.

3. The heating element of claim 2 wherein said conducting wires are formed of a highly conductive ribbon material to minimize the voltage drop over the length of the conductor wires whereby the heat produced in the element is produced substantially by the PTC material.

4. A self-limiting electric heating element having a small cross-section and high flexibility adapting it for use in electric blankets and the like comprising a pair of spaced elongated conductors each of which includes a flexible insulating core supporting a conducting wire helically wound thereon, an envelope of positive temperature coefficient material extruded over said spaced conductors to surround said conductors and providing a conducting path between said conducting wires through said material having a resistance at room temperature of on the order of 5,000 to 15,000 ohms/foot, a thermoplastic coating enclosing said positive temperature coefficient material, said coating having a melting point above the melting point of said material to maintain the shape during an annealing operation at a temperature above the melting point of said material and below the melting point of said thermoplastic coating, an insulating spacer positioned in said extruded material between said conductors to prevent contact and maintain substantial spacing between said wires during extrusion or annealing, a coating of polyvinyl chloride surrounding said thermal plastic coating.

5. The heating element of claim 4 wherein said insulating cores and said insulating spacer are substantially coplanar being equal in diameter and extending in parallel spaced relation with said spacer equidistant between said conductors, said envelope of positive temperature coefficient material being oval in cross-section.

6. The heating element of claim 4 wherein said helically disposed conducting wires are disposed in helices which are wound in opposite directions whereby any residual stresses in the spaced conductors counteract each other to produce a nontwisting wire.

* * * * *